United States Patent [19]

Pamplin et al.

[11] Patent Number: 4,464,922

[45] **Date of Patent: * Aug. 14, 1984**

[54] WIRE DRAWING METHOD AND APPARATUS

[75] Inventors: John W. Pamplin, Bishop Auckland; Brian R. Astbury; Richard Shillito, both of Crook, all of England

[73] Assignee: Marshall Richards Barcro Limited, Crook, England

[ * ] Notice: The portion of the term of this patent subsequent to Aug. 24, 1999 has been disclaimed.

[21] Appl. No.: 377,622

[22] Filed: May 13, 1982

Related U.S. Application Data

[63] Continuation of Ser. No. 145,126, Apr. 30, 1980, abandoned, which is a continuation-in-part of Ser. No. 101,561, Dec. 10, 1979, Pat. No. 4,345,451.

[51] Int. Cl.[3] ..... B21C 9/00; B21C 3/14

[52] U.S. Cl. ..... 72/286; 72/41; 72/42; 72/289

[58] Field of Search ..... 72/286, 289, 42, 41; 62/64; 134/64 R, 122 R

[56] References Cited

U.S. PATENT DOCUMENTS

| | | | |
|---|---|---|---|
| 431,499 | 7/1890 | White | 72/289 |
| 742,987 | 11/1903 | Horton . | |
| 957,093 | 5/1910 | Rathbone | 72/289 |
| 1,727,664 | 9/1929 | Nacken | 72/289 |
| 1,737,345 | 11/1929 | Tideman | 72/289 |
| 1,861,563 | 6/1932 | Diehl | 72/289 |
| 1,901,920 | 3/1933 | McMullan | 72/286 |
| 2,057,582 | 10/1936 | McKean et al. | 72/286 |
| 2,109,312 | 2/1938 | Dimmick | 72/39 |
| 2,179,348 | 11/1939 | Penny | 72/286 |
| 2,320,412 | 6/1943 | Cook | 72/286 |
| 2,919,706 | 1/1960 | Williams . | |
| 3,402,589 | 9/1968 | Lathom | 72/289 |
| 3,774,436 | 11/1973 | Tviksta | 72/286 |
| 3,841,129 | 10/1974 | Nishihara et al. | 72/280 |
| 3,973,426 | 8/1976 | Fujita et al. | 72/286 |
| 4,036,046 | 7/1977 | Davies et al. | 72/286 |
| 4,080,818 | 3/1978 | Gré | 72/289 |
| 4,099,403 | 7/1978 | Alcock et al. | 72/289 |
| 4,122,698 | 10/1978 | Herzog | 72/286 |
| 4,214,470 | 7/1980 | Hurst | 72/286 |
| 4,345,451 | 8/1982 | Pamplin et al. | 72/286 |

FOREIGN PATENT DOCUMENTS

| | | | |
|---|---|---|---|
| 2215283 | 10/1973 | Fed. Rep. of Germany | 72/286 |
| 165732 | 9/1922 | United Kingdom . | |
| 1249926 | 10/1971 | United Kingdom . | |
| 1428889 | 3/1976 | United Kingdom . | |

*Primary Examiner*—Daniel C. Crane

*Attorney, Agent, or Firm*—Prutzman, Kalb, Chilton & Alix

[57] ABSTRACT

A method and wire drawing apparatus are disclosed in which rapid cooling of the wire is effected by directly contacting the wire with liquid as it leaves the die and ensuring the wire passes through a bath of coolant while on the block. The bath can be formed against the wire-engaging surface of the block by a cowl.

5 Claims, 5 Drawing Figures

WIRE DRAWING METHOD AND APPARATUS

Figure 1:
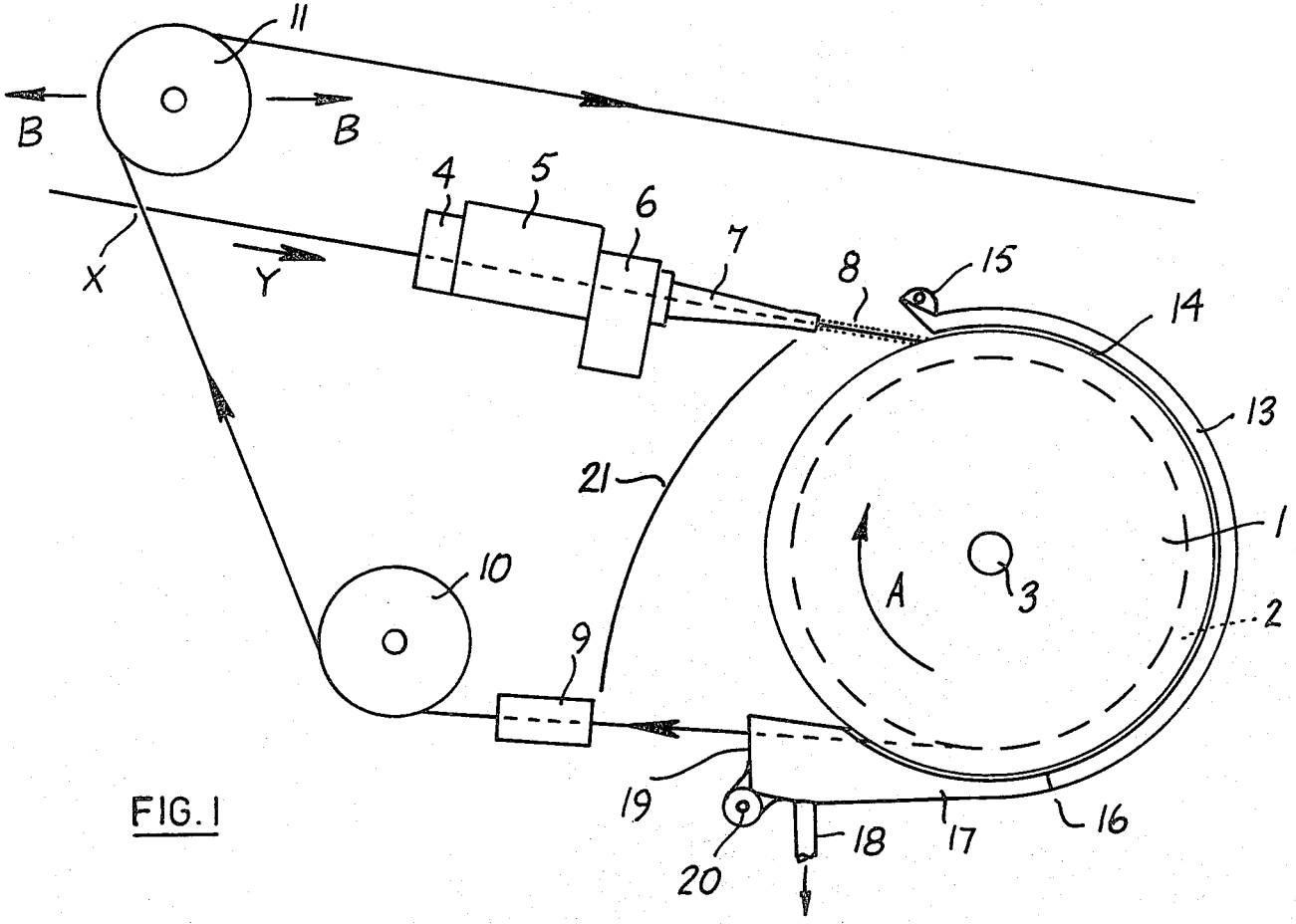

This application is a continuation of application Ser. No. 145,126 filed Apr. 30, 1980, now abandoned is a continuation-in-part of application Ser. No. 101,561 filed Dec. 10, 1979, now U.S. Pat. No. 4,345,451 dated Aug. 24, 1982.

This invention relates to an improved method of drawing wire, in particular ferrous wire, which is a combination of the known dry drawing technique for ferrous wires and the wet drawing technique known for non-ferrous wires. The method has advantages in simplifying the construction and use of a wire drawing machine.

It is conventional practice to draw wire through a sizing opening by wrapping the wire many times around a rotatable drawing block downstream of the sizing opening and using the engagement of the wire around the block to generate the drafting tension required for pulling the wire through the sizing opening. This method of drawing wire (hereinafter referred to as the capstan block method) has been widely used for many years and many different designs of apparatus for operating the method have been developed. To get adequate tension for drawing the wire through the sizing opening it is necessary to wrap the wire several times around the block and it has become conventional practice to extract from the wire the heat generated by the drawing process by cooling the wire while it is on the capstan block. The longer the dwell time of the wire on the block surface, the more efficient the cooling can be and there has thus been a trend towards increasing the number of turns on the block beyond that necessary for traction purposes to meet the cooling requirement as drafting speeds increased. However, a large number of turns on each capstan block of a multi-stage machine increases the complexity and cost of the machine and makes the threading up of the machine complicated and time-consuming.

In U.K. patent specification No. 1,249,926 (BISRA) it has been proposed to cool the wire whilst it is on the capstan block, by directly contacting it with liquid coolant sprays and in U.K. patent specification No. 1,428,889 (Kobe) it has been proposed to cool the wire as it leaves the sizing opening by surrounding the wire with liquid coolant between the opening and the capstan block.

In our U.K. patent application No. 7936943 we describe a wire drawing method which comprises pulling the wire through a sizing opening by engaging the wire in an endless groove of a rotating drawing wheel through an arc of less than 360° and directly contacting the wire between the opening and the wheel with liquid coolant flows.

According to one aspect of the present invention a method of drawing wire which comprises pulling the wire through a sizing opening by wrapping the wire for at least part of a turn around a rotating drawing block to generate the necessary drafting tension for drawing the wire through the sizing opening, contacting the wire immediately downstream of the opening with liquid coolant and removing coolant from the wire downstream of the block, is characterised in that at least an initial part of a turn of the wire on the block is located within a bath of liquid coolant.

Preferably the coolant forms a moving column of liquid which surrounds the wire as it leaves the sizing opening and remains around the wire as it contacts the block. Suitably the liquid forming such a column cools the member defining the sizing opening. Suitably the apparatus for forming the column of cooling liquid around the wire as it is drawn generates helical flows in the column to improve the cooling effect and encourage the maintenance of the column downstream of the opening and onto the surface of the rotating block.

The rotary drawing block can be a grooved wheel as described in our co-pending U.K. patent application No. 7936943 or a flanged capstan block. In the first case less than one complete turn of wire is wrapped around the drawing block while in the second case a few complete turns of wire will be disposed around the drawing block.

The liquid coolant is normally water or a water-based solution and preferably the bath of coolant is formed between the block and a cowl closely surrounding the block for a substantial part of the circumference of the block downstream of the point of first contact of the wire on the block.

Surprisingly we find we can dissipate the heat generated by the heaviest drafting schedules in the short time in which the wire is passing to the block and is retained on the block. With conventional prior art capstan blocks (e.g. with typically 20–100 turns of wire on the block) transit times in which the wire was on the block ranged from say 10 to 100 seconds. At comparable drawing speeds and with a block of comparable diameter, the time available for cooling the wire in a method according to the invention is very much reduced, the entire cooling being effected in times of say 0.1 to 5 seconds.

The liquid coolant is suitably removed from the wire by means of an air wipe in which compressed air is fed into a chamber surrounding the wire, the chamber being limited in both upstream and downstream directions of the wire path therethrough by apertured plates whose wire-receiving apertures are only slightly larger than the cross-section of the wire passing therethrough.

Conveniently the method of the invention is used for the stages of a multi-stage wire drawing operation in which the cross-section of the wire is progressively reduced stage by stage from an input feedstock to the final drawn wire.

The wire can be lubricated with a water-insoluble (e.g. a calcium-based) powder or, if electrostatic coating techniques are used to ensure powder coating of clean metal, a water-soluble lubricant powder (e.g. a sodium-based material).

The sizing openings can be fixed dies which are provided with liquid cooling on their downstream faces.

Drafting pulls of 25,000 Kg are obtainable with area reductions per stage in excess of 40% easily realisable. Although cooling has to be accomplished in a much shorter time than with a prior art capstan machine, we have successfully dissipated 33 KW of power in one stage of a multi-stage apparatus with an output wire temperature from that stage of less than 90° C. (representing a temperature increase of less than 75° C.). Drafting speeds in excess of 22 m/sec have also been achieved and it is expected that drawing speeds at least equal to the best obtainable in prior art capstan machines can be obtained. Galvanised and ungalvanised ferrous wires can be drawn by the method of the invention.

According to a further aspect of the invention, wire drawing apparatus comprising a sizing opening for the wire, means to supply liquid coolant to surround the wire as it leaves the opening, a rotatable drawing block downstream of the opening with means to rotate the block in a direction to draw wire, wrapped in at least a part turn around the block, through the sizing opening, means to keep the wire wet with coolant on the block and means downstream of the block to remove coolant from the wire, is characterised in that a cowl closely confronts the wire-engaging surface of the block for a part turn therearound from the initial point of contact of wire on the block to ensure the wire is immersed in a bath of coolant for at least an initial part of one turn of the wire on the block.

The rotating block can contain a single endless V-groove in which the wire is located for a part of one turn around the block, but alternatively the block can accommodate a few turns (say three to five) preferably on a slightly tapering cylindrical surface formed between side flanges of the block. If the cowl is located very close to the outer peripheral edge of the side flanges it will define a volume, limited on the radially inward side by the wire-engaging surface of the block, which can be filled with liquid coolant during use of the block, to form the coolant bath through which the initial part turn of wire on the block will pass.

The cowl can be movable away from the block to facilitate threading-up of the machine.

Since the wire makes few turns around the block in apparatus according to this invention, threading-up of a multi-stage apparatus according to the invention is much easier to achieve than would be the case in a conventional multi-stage capstan block machine. Further, since only a few turns of wire engage each block, the wire paths to and from each block need be displaced by little more than a few diameters of the wire and this means that there need be little displacement of the wire out of a single plane from the inlet end of a multi-stage apparatus to the outlet end.

Where a powdered lubricant is employed upstream of each sizing opening, this would normally be located in a soap box through which the wire passes immediately before entering the sizing opening. An air wipe is preferred to remove residual liquid coolant from the wire prior to its entering the next soap box, this using axially directed compressed air streams which surround the wire to blow the coolant from the wire surface. To improve soap utilisation, it is advantageous to use constantly circulating lubricant supplies for each soap box. The lubricant powder can be drained from each soap box, to facilitate threading-up.

Conveniently the blocks in a multi-stage apparatus are disposed with their rotating axes lying in parallel planes and suitably with their rotating axes disposed horizontally.

Suitably each block is located within a casing so that although the wire on the block is flowing through a coolant bath, coolant can be prevented from impinging on coolant-free parts of the wire path. The coolant used can collect in a trough (suitably forming part of the base of the apparatus) and be filtered and optionally cooled before being returned to the casings. A recirculating coolant system can be provided in this way.

Conveniently the control of the torque applied to the blocks in a multi-stage apparatus, and hence their relative rotational speeds, is effected either by sensing the position of a dancer pulley between each block and its respective downstream sizing opening or by sensing the tension generated by the wire on a fixed guide pulley disposed between each block and its respective downstream sizing opening. Preferably, in the latter case, the journals mounting the guide pulley are connected to a force transducer (e.g. a load cell) which associates an electrical signal with the magnitude of the back tension generated in the wire at each sizing opening.

Conventional electrical control circuits can be used to convert the outputs of the force transducers into torque control signals for the respective motors.

As an alternative to forming a shallow coolant bath against the wire-engaging surface of the or each block by means of a cowl, the block can be immersed in a deep bath of liquid coolant, wire leaving the bath when it has left the block.

The method and apparatus of the invention can be used with both ferrous and non-ferrous wires of both circular and non-circular cross-section.

The sizing openings can be of any conventional kind (e.g. fixed dies or roller dies) but fixed dies would be the normal choice.

Figure 2:
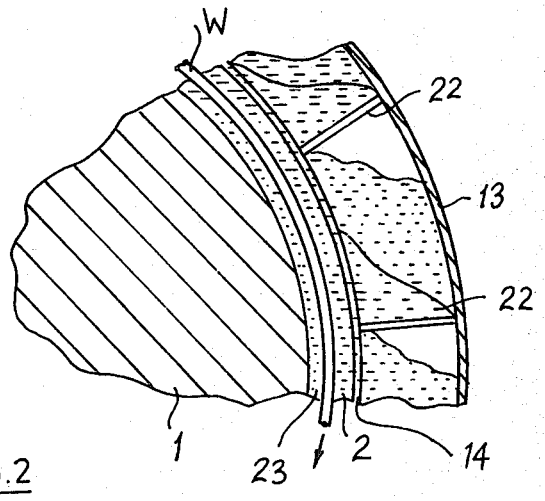
Figure 3:
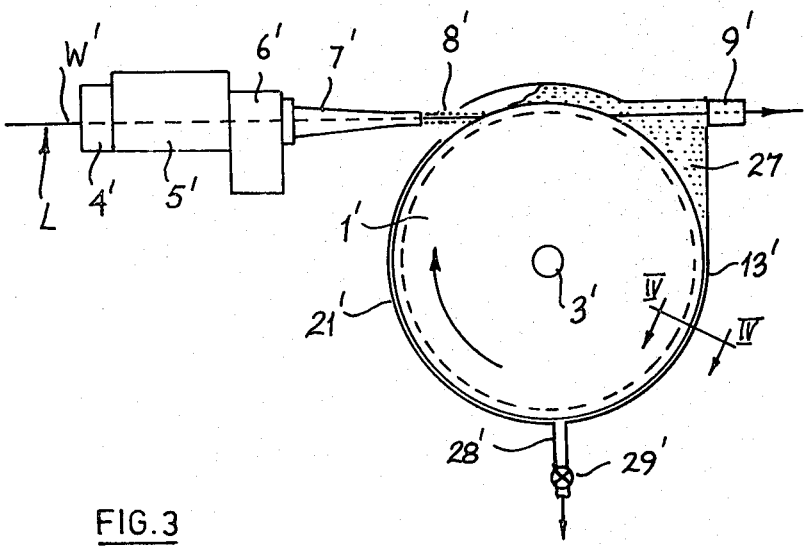
Figure 4:
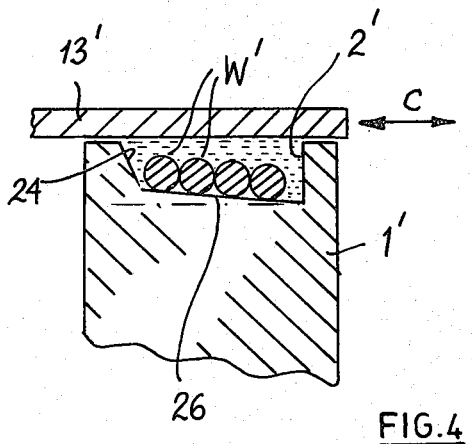
Figure 5:
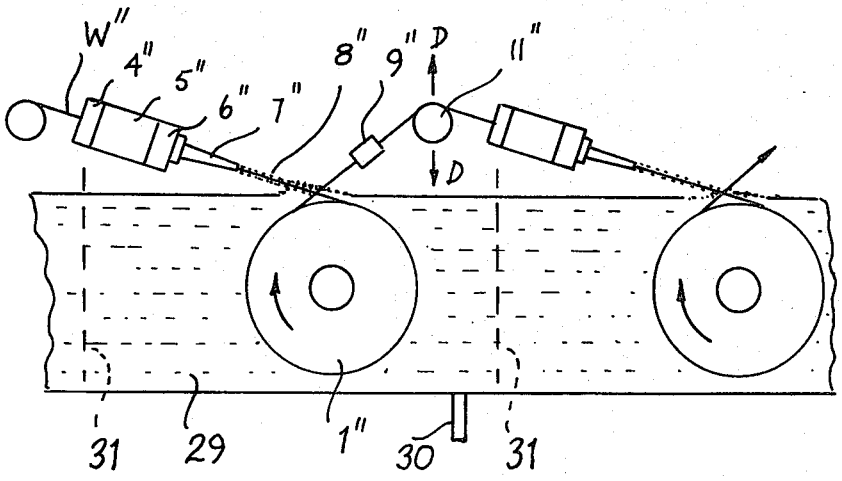

The invention will now be further described, by way of example, with reference to the accompanying drawings, in which:

FIG. 1 is a general view of one stage of a first embodiment of multi-stage wire drawing apparatus in accordance with the invention, FIG. 2 is an enlarged view of part of the periphery of the block in FIG. 1 showing the cowl used to enhance the cooling effect on the wire being drawn, FIG. 3 is a general view of one stage of a second embodiment of multi-stage wire drawing apparatus in accordance with the invention, FIG. 4 is a schematic cross-section taken on the line IV—IV of FIG. 3, and FIG. 5 shows two stages of a multi-stage drawing apparatus using a deep coolant bath for the drawing block in each stage.

FIG. 1 shows the wire path for one stage of a multi-stage wire-drawing apparatus of the kind described in U.K. patent application No. 7936943, with the wire entering the stage illustrated from the left in the direction of the arrow Y either from a spool of input material or from a preceding stage. A drawing block 1 provided with a V-groove 2 indenting its circumferential surface is rotatably mounted about a horizontal axis 3 for rotation in the direction of the arrow A and by virtue of trapping of the wire in the groove 2 draws the wire through a guide die 4, a soap box 5 and a sizing die 6. Downstream of the die 6 there is provided a shroud 7 which forms a coherent column of liquid coolant around the wire which column is shown at 8 issuing onto the cylindrical surface of the block 1.

The column of coolant 8 is trapped against the surface of the block 1 to form a coolant bath (through which the wire on the block surface passes) by the provision of a cowl 13 closely surrounding the periphery of the block 1 around an arc of approximately 180°. The narrow gap 14 between the cowl 13 and the block 1 has been shown exaggerated in FIG. 1 and in practice would be of the order of a tenth of a mm. The cowl 13 is pivoted at 15 to permit it to be swung away from the block 1 to facilitate the threading-up operation of the apparatus. The downstream end 16 of the cowl 13 closely confronts the upstream end of an opentopped trough 17 having a drain connection 18. Coolant leaving the cowl 13 fills this trough above the level of the wire passing through it and ensures that the wire is located in a coolant bath all the while the wire is trapped in the groove 2. A vertical slot is provided in the downstream end wall 19 of the trough 17 to receive the wire and the trough is pivoted about a turning axis 20 to enable it to be moved away from the block 1 on the occasion of threading-up. A stationary baffle 21 prevents splashes of coolant from the block 1 contacting wire downstream of an air wipe 9.

After passing through the air wipe 9, the wire passes around guide pulleys 10 and 11 into an upper wire path 12 which leads on to the next stage of the apparatus, or to a spooler for finished wire.

The guide pulley 11 can form part of a speed control system for one stage of the apparatus and is mounted for limited movement in the directions of the arrows B.

At the point X where the wire paths cross, a small clearance is provided between the wires (e.g. a clearance of 3 centimetres) and this clearance can easily be provided by slightly angling either or both the guide pulleys 10 and 11.

The air wipe 9 can comprise a chamber surrounding the wire which is limited at its ends by apertured plates whose wire-receiving apertures are only slightly larger than the cross-section of the wire. The chamber can be fed with compressed air (e.g. at a pressure of about 30 psig), the air streams leaving the chamber through the end plates (and particularly the upstream end plate) removing water from the surface of the wire.

FIG. 2 shows in detail part of the cowl 13 and the coolant flows arising during a drawing operation. Baffle plates 22 are disposed within the channel defined by the cowl 13 and provide spaced-apart weirs to dam back the coolant attempting to be flung radially outwards from the surface of the block 1. The baffles slow down the flow of coolant within the cowl forcing it back against the block as it drains past each baffle. In this way a coherent coolant bath is formed against the surface of the block 1. FIG. 2 also shows the coolant (indicated at 23) which is trapped by the wire in the groove 2.

FIGS. 3 and 4 show one stage in a second embodiment of apparatus in accordance with the invention, similar reference numbers, but with a prime, having been used in these Figures to those used in FIGS. 1 and 2, where similar integers are involved.

The main difference between the arrangement in FIGS. 1 and 3, is that the block 1' in FIG. 3 is a narrow capstan block accommodating four turns of wire. The groove 2' formed in the block 1' has a tapered side wall 24 onto which the wire W' is led as it leaves the shroud 7'. The inclination of the side wall 24 and the slight taper of the base 26 of the groove 2' (much exaggerated in FIG. 4 and of the order of $\frac{1}{2}°$ in practice) cause the turns of wire on the block 1' to progress to the right in FIG. 4 as drawing proceeds.

The cowl 13' which traps the bath of liquid coolant against the periphery of the block 1' is shown in FIG. 4 as a plane arcuate plate which is close to the circumference of the block 1'. Upstream of the point sectioned in FIG. 4, the cowl diverges from the peripheral surface of the block 1' to meet with generally triangular side walls to form a closed volume 27 which becomes filled with coolant during use of the apparatus.

Since the wire makes four complete turns around the block 1', its lead-off direction is substantially coplanar with its lead-on direction, so that the air wipe 9' is located to one side of the coolant-filled closed volume 27 in the inlet region of the block 1'.

A coolant drain 28 is located in the lowest point of the cowl 13' and this drain can be provided with a valve 29 to set the outflow rate of coolant and ensure adequate filling of the volume 27 with coolant.

The cowl 13' can be moved in the direction of the arrows C in FIG. 4 to faciliate threading-up of the apparatus.

In the arrangement of FIGS. 3 and 4, a load cell can be located at the position marked L, just upstream of the guide die 4', to control the speed of the block 1' in known manner.

Referring now to FIG. 5, there is shown two stages of a third embodiment of apparatus in accordance with the invention. Again similar reference numerals, this time with a double prime, have been used to designate similar integers.

Referring to FIG. 5, wire W" enters the upstream stage from the left and passes through a guide die 4", a soap box 5" and a sizing die 6" before passing into an endless groove 2" in a drawing block 1" rotating in the direction of the arrow. The block 1" is submerged in a bath 29 of water and after making almost three turns around the block 1", the wire leaves the groove 2" and passes up out of the bath to the air wipe 9" and over a pulley 11". The air wipe 9" completely dries the wire W" in preparation for its passage through the guide die, soap box and sizing die of the next upstream stage.

A shroud 7" is employed on the downstream side of the die 4", the sleeve being fed with water at its upstream end so that a moving column 8" of water surrounds the wire as it leaves the die and travels with the wire into the bath 29. The column 8" may be induced to turn helically around the wire to ensure the coherence of the column 8" and to increase the relative speed between the wire and the coolant in the column.

The pulley 11" can be mounted to move in the directions of the arrows D for speed control purposes in the manner well known in the wire drawing art. A drain 30 is provided to permit the bath to be emptied of water and optionally to allow continuous circulation of water through the bath as wire drawing proceeds.

The bath 29 can be divided (e.g. as shown dotted at 31) so that each block has its own coolant bath.

What is claimed is:

1. In a method of drawing ferrous wire employing a plurality of drawing stages for continuously drawing the ferrous wire to successively smaller sizes, with each stage comprising a wire drawing die for reducing the size of the wire, a soap box upstream of the die having a dry wire lubricant for lubricating the ferrous wire for drawing the wire to a smaller size and a rotatable draw block downstream of the die having an outer coaxial generally cylindrical surface for receiving a plurality of turns of wire for drawing the wire with the draw block through the die, the improvement wherein said method comprises, at each of a plurality of successive drawing stages, drawing the ferrous wire through the respective die with a plurality of turns of wire on the respective draw block, providing a draw block cowl extending at least partly around the draw block to form with the draw block a liquid coolant reservoir extending at least partly around the cylindrical surface of the draw block for holding liquid coolant in contact with the draw block and each of the plurality of turns of wire thereon, and continuously cooling the wire by continuously conducting a water based liquid coolant into contact with the ferrous wire along the wire path from the die to the draw block and into the liquid coolant reservoir into contact with the draw block and each of said plurality of turns of wire on the draw block, and drying the wire between each upstream draw block and downstream soap box of said plurality of successive drawing stages.

2. In a wire drawing apparatus having a plurality of drawing stages for continuously drawing wire to successively smaller sizes respectively, with each drawing stage comprising a wire drawing die for reducing the size of the wire, a soap box upstream of the die having a dry wire lubricant for lubricating the wire for drawing the wire to a smaller size and a rotatable draw block downstream of the die having an outer coaxial, generally cylindrical surface for receiving a plurality of turns of wire for drawing the wire with the draw block through the die, the improvement wherein in at least one of the drawing stages of the drawing apparatus, the draw block comprises a peripheral circular groove providing said coaxial generally cylindrical surface for receiving a plurality of turns of wire for drawing the wire with the draw block through the respective die and having end flanges at opposite axial ends of the cylindrical surface, a draw block cowl extending at least partly around the draw block and forming with the draw block a liquid coolant reservoir extending at least partly around the cylindrical surface of the draw block for holding liquid coolant in contact with the draw block and each of the plurality of turns of wire thereon, wire cooling means for continuously conducting a water based coolant into contact with the wire along the wire path from the die to the draw block and into the liquid coolant reservoir into contact with both the draw block and the plurality of turns of wire thereon, and an air wipe for drying the wire downstream of the draw block.

3. In a wire drawing apparatus comprising at least one wire drawing stage having a wire drawing die for reducing the cross-section of the wire, a soap box upstream of the die having a dry wire lubricant for lubricating the wire for drawing the wire to a smaller size and a rotatable draw block downstream of the die having an outer coaxial, generally cylindrical surface for receiving a plurality of turns of wire for drawing the wire with the draw block forwardly along a wire transport path extending through the soap box and die, the improvement wherein said one drawing stage comprises a draw block cowl extending at least partly around the draw block and forming with the draw block a liquid coolant reservoir extending at least partly around the cylindrical surface of the draw block for holding liquid coolant in contact with the draw block and each of the plurality of turns of wire thereon, and liquid cooling means for directly and continuously conducting a liquid coolant into contact with the wire along its transport path from the die to the draw block and into said coolant reservoir into contact with the draw block and each of the plurality of turns of wire on the draw block.

4. A wire drawing method comprising at least one drawing stage having the steps of drawing a wire through a die with a rotating draw block mounted downstream of the die and having a plurality of turns of wire wrapped thereon for drawing the wire through the die with the draw block, providing a draw block cowl extending at least partly around the draw block to form with the draw block a liquid coolant reservoir extending at least partly around the draw block for holding liquid coolant in contact with the draw block and each of the plurality of turns of wire thereon, and directly cooling the wire with a continuous flow of liquid coolant including continuously conducting the liquid coolant into contact with the wire along the wire path from the die to the draw block and into the liquid coolant reservoir into contact with the draw block and each of the plurality of turns of wire wrapped thereon.

5. In a method of drawing wire employing a drawing stage comprising a wire drawing die for reducing the size of the wire, a soap box upstream of the die having a dry wire lubricant for lubricating the wire for drawing the wire to a smaller size and a rotatable draw block down-stream of the die having an outer generally cylindrical surface for receiving a plurality of turns of wire for drawing the wire through the die, the improvement wherein said method comprises drawing the wire through the respective die with a plurality of turns of wire on the draw block, providing a draw block cowl extending at least partly around the draw block to form with the draw block a liquid coolant reservoir extending at least partly around the draw block for holding liquid coolant in contact with the draw block and each of the plurality of turns of wire thereon, and continuously cooling the wire by continuously conducting a water based liquid coolant into contact with the wire along the wire path from the die to the draw block and into the liquid coolant reservoir into contact with both the draw block and the plurality of wire turns on the draw block, and drying the wire downstream of the draw block.

* * * * *